US008690381B2

(12) United States Patent
Yu

(10) Patent No.: US 8,690,381 B2
(45) Date of Patent: Apr. 8, 2014

(54) LUMINAIRE SYSTEM AND METHOD

(71) Applicant: Scott S Yu, Mill Valley, CA (US)

(72) Inventor: Scott S Yu, Mill Valley, CA (US)

(73) Assignee: Vode Lighting LLC, Sonoma, GA (US)

( * ) Notice: Subject to any disclaimer, the term of this patent is extended or adjusted under 35 U.S.C. 154(b) by 0 days.

(21) Appl. No.: 13/838,224

(22) Filed: Mar. 15, 2013

(65) Prior Publication Data

US 2013/0208475 A1 Aug. 15, 2013

Related U.S. Application Data

(63) Continuation of application No. 12/897,470, filed on Oct. 4, 2010, now abandoned.

(51) Int. Cl.
*F21V 33/00* (2006.01)

(52) U.S. Cl.
USPC ..... 362/219; 362/249.02; 362/225

(58) Field of Classification Search
USPC ..... 362/249.02, 219, 220, 217.14, 217.15, 362/225
See application file for complete search history.

(56) References Cited

U.S. PATENT DOCUMENTS

| | | | | |
|---|---|---|---|---|
| 7,758,208 | B2 * | 7/2010 | Bailey | 362/231 |
| 8,052,299 | B2 * | 11/2011 | Lin | 362/219 |
| 2010/0142205 | A1 * | 6/2010 | Bishop | 362/249.02 |
| 2010/0157593 | A1 * | 6/2010 | Zhou et al. | 362/235 |
| 2010/0214779 | A1 * | 8/2010 | Kao | 362/249.02 |

* cited by examiner

*Primary Examiner* — Laura Tso
(74) *Attorney, Agent, or Firm* — Antero & Tormey LLP; Pete Tormey

(57) ABSTRACT

A device, kit, and method for a luminaire having a first LED module with a first length and a plurality of LEDs, said LEDs disposed at predetermined pitch. A second LED module having a second length and a plurality of LEDs, said LEDs disposed at the same pitch as the first module. Wherein said first LED module and said second LED module have at least one LED disposed one half of the pitch from an edge of the LED module which when combined provide for uniform lighting across multiple LED modules. Certain embodiments may include one or more hubs for mounting the luminaire on predetermined centers.

13 Claims, 2 Drawing Sheets

LUMINAIRE SYSTEM AND METHOD

PRIORITY

This application is a continuation of co-pending U.S. patent application Ser. No. 12/897,470 by the same inventor filed on Oct. 4, 2012 which is incorporated by reference as if fully set forth herein.

BACKGROUND

The present invention relates generally to luminaires and more particularly to a system and method for disposing LED and other light sources onto a luminaire such that the luminaire provides uniform lighting and conforms to a structure's metrics.

Lighting fixtures and luminaires are basic lighting devices used in homes, offices and a variety of industrial settings. One criterion when selecting a lighting fixture is that the lighting is visually attractive. Visual attractiveness includes more than the appearance of the luminaire itself but also includes the aesthetic affect of the light provided by the luminaire. Other criteria include low cost, ease of installation, performance, safety and legality. For industrial lighting the cost of installation may be more than the cost of the device because industrial lighting generally requires designs to satisfy many of the above listed criteria. For example, lighting in a warehouse may be required to meet minimum light intensity and safety requirements. This entails the use of a lighting designer or architect who would specify the source and type of luminaire desired for the specified task.

In addition, industrial lighting requires more detailed installation because industrial lighting is often installed as part of a larger design of a factory or workspace. The details of the lighting system must be specified in advance so that pricing, delivery and planning can be properly performed. Also industrial lighting often must meet higher local safety requirements. It is clear that ease of use and lower cost may be effectuated at the design, installation and usage stages of a lighting system.

Improvements that provide for an easier to design or an easier to install lighting system lower overall lighting costs. In addition, improvements that provide ease of manufacture may provide lower costs because fewer parts may be required and the manufacturer can gain from economies of scale. One area that has improved lighting designs is in the construction and use of light emitting diodes (LEDs) as light sources. With the development of high efficiency and high power LEDs it has become possible to incorporate LEDs in industrial lighting. LEDs are low-voltage lamps, requiring a constant direct current (DC) voltage or current to operate optimally. An individual LED may need 2-4V of DC power and several hundred milliamps (mA) of current. When LEDs are connected in series in an array, higher voltage is required. An LED driver acts as this power supply by converting incoming power to the proper low-voltage DC power required by the LEDs.

During operation, the LEDs must be protected from line-voltage fluctuations because changes in voltage can produce a disproportional change in current, which in turn changes light output. (LED light output is proportional to current and is rated for a current range. If current exceeds the manufacturer recommendations, the LEDs can become brighter but their light output can degrade at a faster rate due to heat, shortening useful life. Useful life may be defined as the point where light output declines by 30 percent.) The LED driver regulates the current flowing through the LED during operation and protects it from voltage fluctuations. Led drivers are manufactured and sold as modules including one or more LEDs and control circuitry.

Design of luminaires may require certain physical characteristics because of the location of the luminaire. For example domestic construction often uses wall supports ("studs") on 16 inch spacing whereas industrial settings may use alternative spacing such as 24 inches. This requires a luminaire system design that comports to the building metrics without excessive costs. Moreover the intensity of lighting provided by the luminaire must provide for uniformity to reduce adverse affects on users.

Accordingly, improvements to LED-based lighting designs that lower costs of manufacture, design or installation are beneficial.

SUMMARY

Disclosed herein is a method of designing a modular lighting system comprising determining a length of a lighting fixture, then selecting a plurality of light emitting diode (LED) modules where the modules may be of differing sizes. And assembling the modules together with a chassis, so that the modules and the chassis combine to form the determined length. In some embodiments the selecting is done from a group comprising a 10 inch, a 12 inch or a 4 inch LED module.

Also disclosed is a luminaire comprising a chassis having a predetermined length; and at least 2 light emitting diode modules, each having a different length, where the lengths of the fixture and the modules combined form a standard length as generally used in the building and construction trades. By way of example, these standard lengths could be 12, 16 or 24 inches, but may include others.

Also disclosed is a device, kit, and method for a luminaire having a first LED module with a first length and a plurality of LEDs, said LEDs disposed at predetermined pitch. A second LED module having a second length and a plurality of LEDs, said LEDs disposed at the same pitch as the first module. Wherein said first LED module and said second LED module have at least one LED disposed one half of the pitch from an edge of the LED module which when combined provide for uniform lighting across multiple LED modules. Certain embodiments may include one or more hubs for mounting the luminaire on predetermined centers.

The construction and method of operation of the invention, however, together with additional objectives and advantages thereof will be best understood from the following description of specific embodiments when read in connection with the accompanying drawings.

DESCRIPTION

Figure 1:
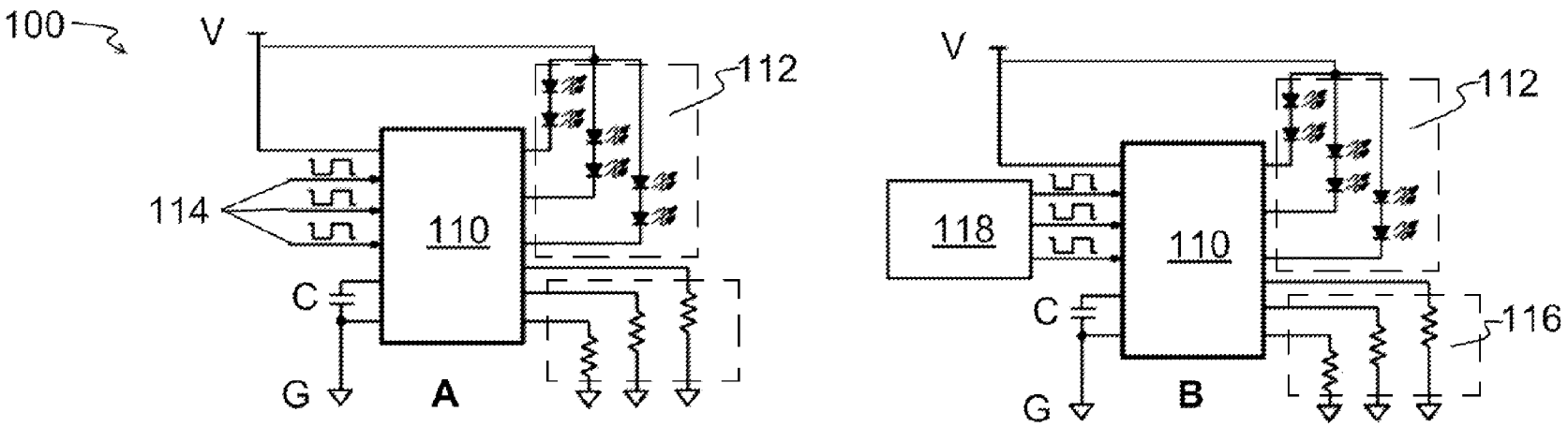
FIG. 1 illustrates a schematic diagram of a conventional light emitting diode (LED) module for use in a luminaire.

Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Lexicography

Read this application with the following terms and phrases in their most general form. The general meaning of each of these terms or phrases is illustrative, not in any way limiting.

The term "standard length" generally refers to the uniform spacing as found in the building and construction industry. One standard length is 16 inches, which is usually specified for the distance between studs on a wall. Other standard lengths include, but are not limited to 12 inches and 24 inches. These standard lengths are often found in the construction of industrial lighting systems because and are used for specifying electrical drops in industrial settings.

The term "luminaire" generally refers to a lighting fixture complete with the light source or lamp and connection to a power source. A Luminaire may optionally have a reflector for directing the light, an aperture (with or without a lens), the outer shell or housing for lamp alignment and protection, an electrical ballast, if required, However, for purposes of this disclosure, a luminaire may not require every part listed above, but may be comprised of only a portion of the listed components.

The term "Driver" generally refers to circuitry for operating one or more LEDs. A driver typically acts to adjust the voltage or current to the LED to effectuate a given amount of light. Often drivers are coupled to more sophisticated electronics for control of the LEDs.

The term "circuit board" generally refers to a mechanical support structure used to hold and electrically connect electronic components using conductive pathways, (or traces), etched from copper sheets laminated onto a non-conductive substrate. Circuit boards are often formed from rigid, fire-retardant material, but may also be formed from flexible materials to allow forming the circuit board to fit a given application.

The terms "chassis" an "rail" generally refer to a material designed for holding a light source. It may include a reflector to direct the light in a particular pattern.

DETAILED DESCRIPTION

FIG. 1 illustrates a schematic diagram of a conventional light emitting diode (LED) module 100 for use in a luminaire. In the FIG. 1A, a driver 110 comprised of an integrated circuit controls several LEDs 112. The driver 110 is connected to a power supply V and a ground G. Circuit elements are connected to the driver 100 depending on the driver 100 manufacturer. In the FIG. 1 these circuit elements are shown as resisters and capacitor C. The driver is operated by 3 control lines 114. The signal on the control lines determines the light intensity of the LEDs 112.

In operation the driver 110 can dim LEDs by reduction in the forward current, pulse width modulation (PWM) via digital control, or more sophisticated methods. Most dimming drivers operate using the PWM method. With this method, the frequency could range from a hundred modulations per second to as high as hundreds of thousands of modulations per second, so that the LED appears to be continuously lighted without flicker. A benefit of the PWM method is that it enables dimming with minimal color shift in the LED output.

In the FIG. 1B, a microprocessor 118 is coupled to the control lines of the driver 110. By coupling the control lines to a programmable device, more advanced operations of the LED module 100 may be effectuated. For example, by coupling the processor 118 to a network (not shown), control of sets of LED assemblies 100 may be employed. Additionally, advanced controls could be connected to the processor 118 such as occupancy sensors, timers and power saving tools may be used with the LED module 100.

An LED module 100 may be effectuated using convention circuit board material including flexible material. The drive and LED are mounted to the circuit board and the circuit board sized to the appropriate dimensions according to a desired application. In certain applications an LED module may comprise only the LEDS and have the control circuits remote to the LED module.

References in the specification to "one embodiment", "an embodiment", "an example embodiment", etc., indicate that the embodiment described may include a particular feature, structure or characteristic, but every embodiment may not necessarily include the particular feature, structure or characteristic. Moreover, such phrases are not necessarily referring to the same embodiment. Further, when a particular feature, structure or characteristic is described in connection with an embodiment, it is submitted that it is within the knowledge of one of ordinary skill in the art to effectuate such feature, structure or characteristic in connection with other embodiments whether or not explicitly described. Parts of the description are presented using terminology commonly employed by those of ordinary skill in the art to convey the substance of their work to others of ordinary skill in the art.

Figure 2:
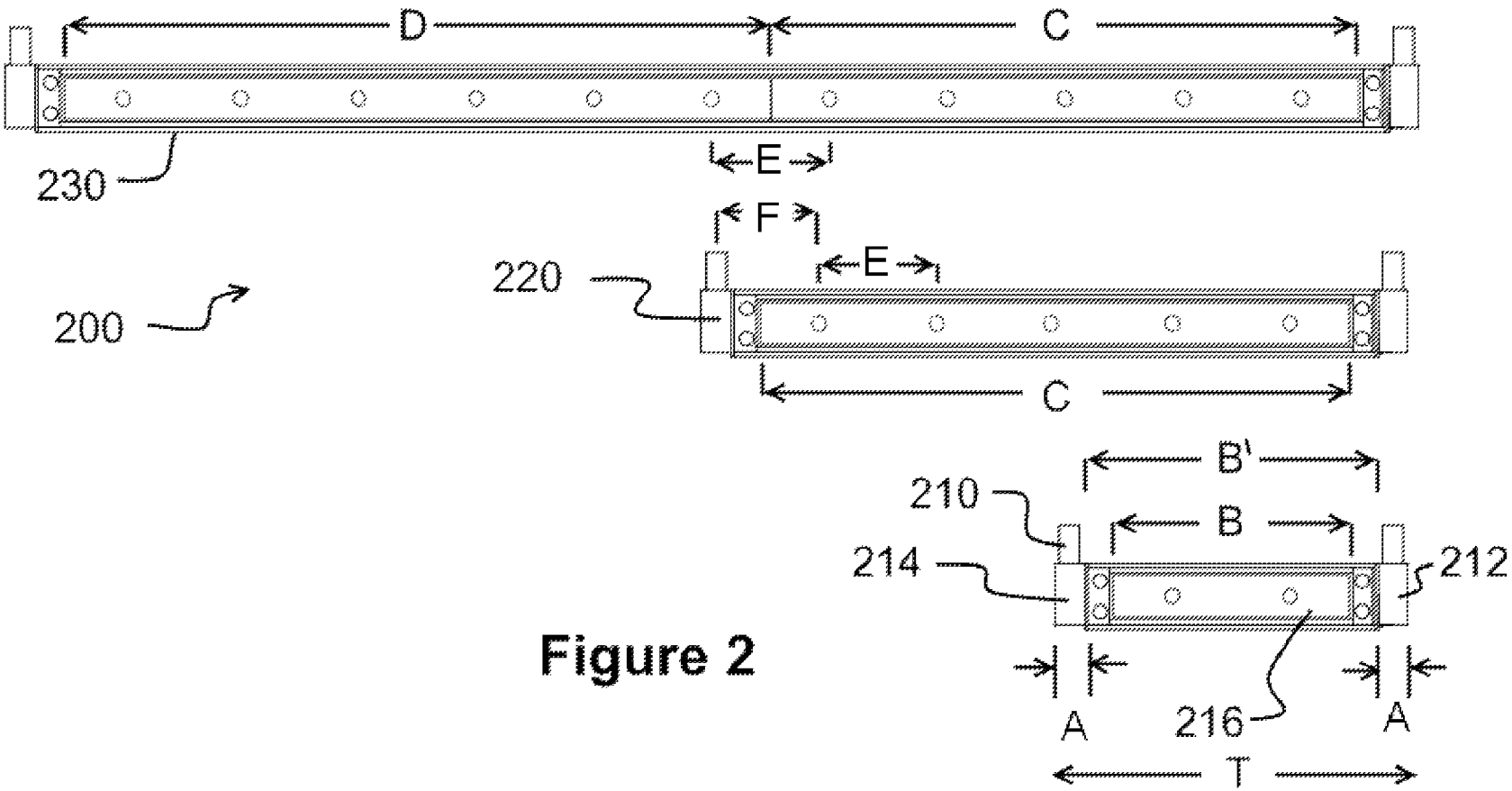
FIG. 2 illustrates several luminaires of varying lengths.

FIG. 2 illustrates several luminaires of varying lengths 200. In FIG. 2 a first luminaire 210 is shown having two fixtures or hubs 212 and 214. The hubs 212 and 214 provide for mounting the luminaire chassis (or rail) and may also provide for electrical connections and positioning of a reflector (not shown). Length A is the longitudinal length of each hub 212 and 214. Disposed on the chassis between the hubs is a circuit board having one or more LED modules, which together comprise an LED module 216. The LED module 216 is shown having 2 LEDs, but may include more. The number of LEDs on the module may vary depending on the type of LED employed and other considerations. The LED module 216 is mounted to the chassis and electrically isolated from the chassis material. The inventor contemplates a chassis made of suitable material to provide a heat sink for the LEDs, such as aluminum, copper or other metal. One having skill in the art will appreciate that, depending on the LEDs employed, other material may be employed.

The length of the chassis is B'. The hubs 212 and 214 provide for physically mounting the chassis to a support and for providing electrical power to the luminaire. To effectuate the design of the FIG. 2, each hub 212 and 214 would be ½ inch and the length of the chassis would be five inches and the circuit board 216 would be 4 inches. This provides for a 6 inch total length luminaire.

The total length T of the luminaire 210 is the length of each hub 212 and 214 together with the length of the chassis B'. The total length is shown by T=B'+2A, where B' is the length of the chassis and A is the length of a hubs. For an example of providing a luminaire of a standard length, the luminaire 210 is formed so that length B is 4 inches and length A is ½ inch and B' is 5 inches. Together, according to the formula presented herein the total length of the luminaire is 6 inches.

Luminaire 220 is similar to luminaire 210 except that the length of the LED module is C. By providing an LED module where the length C is 10 inches and the length of the hubs is ½ inch each and the chassis is 11 inches, a luminaire of substantially 12 inches may be formed. A luminaire 220 would be a standard length for use in a lighting system. As discussed above, the standard lengths may depend on the industry and location.

Luminaire 230 is similar to both luminaire 210 and luminaire 220 except that an LED module having a length D is disposed in series with an LED module having a length C. The LED modules length C and D may each be provided with electrical connections to allow for electrically coupling the LED modules together. Close fitting connectors would allow for LED modules to be sized to fit closely and maintain uniform lengths. Moreover, the edges of the LED modules may be designed to be closely abutted with other LED modules. By way of example length D could be 12 inches providing the total length for LED modules as 22 inches. This would be mounted on a 23 inch rail, which together with 2 hubs would mount to a building metric having 24 inch centers.

One having skill in the art will recognize that the LED modules may be made from fixed or flexible material as long as they are capable of mounting to the luminaire chassis. In addition, the hubs would be matched to provide a standard length for the hubs at each end. The standard length would depend on the length of the LED module. LED module lengths are depicted as 4, 10 and 12 inches but other lengths could be fabricated to effectuate a similar result. For example and without limitation LED modules lengths could be produced in metric units. This might entail a 225 mm length coupled with multiple 250 mm lengths and uniform length hubs to provide for luminaires on specific centers.

Certain embodiments may include LED module formation to allow for uniform spacing between LED modules on an LED module and also when two LED modules are positioned together. Dimension E in FIG. 2 shows the spacing between two LEDs (the "Pitch"). Aesthetic lighting design provides for light distribution that is uniform. Uniformity includes not only the pitch of the light sources, but control of the "dark space" between multiple lighting modules. Some embodiments may eliminate this dark space between modules by maintaining the pitch E between LED modules and LEDs mounted on a module. Other embodiments may provide for uniform dark space between LED modules that is different from the LED pitch on an LED module. In certain embodiments uniform dark space may be provided by using equal length hubs and by providing a uniform distance between an LED and the edge of an LED modules shown as F in FIG. 2.

In operation, luminaires of standard lengths could be provided by selecting hubs of a predetermined length, and then providing rails and LED modules in combinations that, when added to the hub length, provide for a total length of the luminaire to be a predetermined amount or a standard length. The examples shown in the FIG. 2 provide for a 6 inch, a 12 inch and a 24 inch luminaire. One advantage to LED modules of 4, 10 and 12 inches (or their metric equivalents) is that in combination luminaire lengths can be fabricated to meet the most common standardized building metrics. For example and without limitation, a 10 inch LED module, and a 12 inch LED module, together with two ½ inch hubs provides for installation on one inch spacing.

During design or installation of a luminaire, a designer would select the length of the luminaire desired based on standard building metrics. A user or computer operated selection program would select the appropriate lengths to effectuate the luminaire such that the length of luminaire supports and the total overall length of the luminaire fall on the studs. By way of example, consider a building having 24 inch stud spacing and requiring 8 feet of a linear luminaire. If a user selected four 24 inch luminaires to effectuate the design, 5 supports would be needed, one on each end and one every 2 feet. These supports must fall exactly on the 24 inch stud. This would require a chassis of 23 inches, a 12 inch LED module and a 10 inch LED module and ½ inch hubs on each end for mounting.

Alternatively an 8 foot design can be effectuated on a single chassis having a 95 inch length using differing combinations of the same LED module lengths. This could be effectuated using two ½ inch hubs and 94 inches of LED modules. For example seven 12 inch modules and a 10 inch module.

By providing multiple sections based on standard components selected as described herein, large lengths of luminaires may be constructed and still conform to building matrices. The standard sized components described herein work in combination to effectuate 6 inch, 12 inch, 16 inch, 24 inch and multiples thereof all from the same few components thus accommodating the most common 12 inch, 16 inch and 24 inch building metrics for wall supports.

The luminaire may be provided as part of a kit where the fixtures and LED modules are provided so that an installer could assemble the luminaire to conform to a requirement. The kit may also include a light rail having reflective properties for operation with the LEDs.

The above illustration provides many different embodiments or embodiments for implementing different features of the invention. Specific embodiments of components and processes are described to help clarify the invention. These are, of course, merely embodiments and are not intended to limit the invention from that described in the claims.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

What is claimed is:

1. A device comprising:

a first LED module, said first LED module having a first length and a plurality of LEDs, said LEDs disposed at predetermined pitch;

a second LED module, said second LED module having a second length and a plurality of LEDs, said LEDs disposed at the same pitch as the first module and said second length different from said first length;

wherein said first LED module and said second LED module have at least one LED disposed one half of the pitch from an edge of the LED module.

2. The device of claim 1 wherein the first length and the second length together are substantially 22 inches or 14 inches.

3. The device of claim 1 wherein the first length and the second length together is substantially 475 millimeters.

4. The device of claim 1 wherein the first LED module is disposed a predetermined distance from a first hub.

5. The device of claim 4 wherein the second LED module is disposed said predetermined distance from a second hub, said second hub having substantially the same length as said first hub.

6. A method comprising:

selecting a primary LED module, said primary LED module having a first length and including a plurality of LEDs spaced at a predetermined pitch;

selecting a secondary LED module, said secondary LED module having a second length and including a plurality of LEDs spaced at the predetermined pitch said second length different from said first length;

coupling the primary LED module and the secondary LED module to a chassis such that the distance between an LED on the primary LED module and an LED on the secondary LED module is substantially equal to the predetermined pitch.

7. The method of claim 6 wherein the first length and the second length together are substantially either 22 inches or 14 inches.

8. The method of claim 6 wherein the first length and the second length together is substantially 475 millimeters.

9. The method of claim 6 wherein the first LED module is disposed a predetermined distance from a first hub.

10. The method of claim 9 wherein the second LED module is disposed said predetermined distance from a second hub, said second hub having substantially the same length as said first hub.

11. A kit comprising:

a first module, said first module having a first length and a plurality of light sources, said light sources disposed at predetermined pitch;

a second module, said second module having a second length, said second length different from said first length, and a plurality of light sources, said light sources disposed at the same pitch as the first module;

wherein said first module and said second module have at least one light source disposed one half of the pitch from an edge of the module.

12. The kit of claim 11 wherein the first length and the second length together are substantially 22 inches or 14 inches.

13. The kit of claim 11 wherein the first length and the second length together is substantially 475 millimeters.

* * * * *